US010410561B2

(12) United States Patent
Park

(10) Patent No.: US 10,410,561 B2
(45) Date of Patent: Sep. 10, 2019

(54) ORGANIC LIGHT EMITTING DISPLAY DEVICE AND DRIVING METHOD THEREOF

(71) Applicant: LG Display Co., Ltd., Seoul (KR)

(72) Inventor: Joonmin Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/683,699

(22) Filed: Aug. 22, 2017

(65) Prior Publication Data

US 2018/0061293 A1 Mar. 1, 2018

(30) Foreign Application Priority Data

Aug. 31, 2016 (KR) ..... 10-2016-0111803

(51) Int. Cl.

| | |
|---|---|
| ***G09G 3/00*** | (2006.01) |
| ***G09G 3/3225*** | (2016.01) |
| ***G09G 3/3266*** | (2016.01) |
| ***G09G 3/3275*** | (2016.01) |
| ***G09G 3/3233*** | (2016.01) |

(52) U.S. Cl.

CPC ..... *G09G 3/006* (2013.01); *G09G 3/3225* (2013.01); *G09G 3/3233* (2013.01); *G09G 3/3266* (2013.01); *G09G 3/3275* (2013.01); *G09G 2300/043* (2013.01); *G09G 2300/0452* (2013.01); *G09G 2300/0866* (2013.01); *G09G 2310/061* (2013.01);

(Continued)

(58) Field of Classification Search

CPC ..... G09G 3/006; G09G 2330/10; G09G 2330/021; G09G 2320/0295; G09G 2310/061; G09G 2330/12; G09G 3/3233; G09G 2300/043; G09G 3/3275; G09G 3/3266; G09G 3/3225; G09G 2300/0866; G09G 2300/0452

See application file for complete search history.

(56) References Cited

U.S. PATENT DOCUMENTS

2005/0264514 A1 12/2005 Kim et al.
2007/0159750 A1* 7/2007 Peker ..... H05B 33/0869 361/93.1

(Continued)

FOREIGN PATENT DOCUMENTS

CN 1806471 A 7/2006
CN 102136250 A 7/2011

(Continued)

OTHER PUBLICATIONS

European Extended Search Report, European Application No. 17187596.6, dated Jan. 22, 2018, 11 pages.

(Continued)

*Primary Examiner* — Charles V Hicks
(74) *Attorney, Agent, or Firm* — Fenwick & West LLP

(57) ABSTRACT

An organic light emitting display device includes a display panel, a data driver, and a scan driver. The display panel includes sub-pixels. The data driver supplies a data signal to the sub-pixels. The scan driver supplies a scan signal for controlling a switching transistor of each sub-pixel, and a sensing signal for controlling a sensing transistor of each sub-pixel. The sensing transistor has a turn-on time for detecting whether a short has occurred between at least two electrodes of a switching transistor in response to a sensing signal.

11 Claims, 14 Drawing Sheets

(52) U.S. Cl.
CPC ..... *G09G 2320/0295* (2013.01); *G09G 2330/021* (2013.01); *G09G 2330/10* (2013.01); *G09G 2330/12* (2013.01)

(56) References Cited

U.S. PATENT DOCUMENTS

| | | | | |
|---|---|---|---|---|
| 2013/0050174 | A1 | 2/2013 | Kim et al. | |
| 2014/0225938 | A1 | 8/2014 | Soni et al. | |
| 2014/0300281 | A1* | 10/2014 | Chaji ..... | G09G 3/3233 315/161 |
| 2015/0154899 | A1 | 6/2015 | Chang et al. | |
| 2016/0189621 | A1 | 6/2016 | Kim et al. | |
| 2016/0343278 | A1 | 11/2016 | Tsujita | |

FOREIGN PATENT DOCUMENTS

| | | | |
|---|---|---|---|
| TW | 201310135 | A1 | 3/2013 |
| TW | 201501100 | A | 1/2015 |
| WO | WO 2015/190043 | A1 | 12/2015 |

OTHER PUBLICATIONS

Taiwan First Office Action, Taiwan Application No. 106128645, dated Mar. 12, 2018, 6 pages.

* cited by examiner

ORGANIC LIGHT EMITTING DISPLAY DEVICE AND DRIVING METHOD THEREOF

This application claims priority to Republic of Korea Patent Application No. 10-2016-0111803, filed on Aug. 31, 2016, which is incorporated herein by reference for all purposes as if fully set forth herein.

BACKGROUND OF THE INVENTION

Field of the Invention

The present invention relates to an organic light emitting display device, and a driving method thereof.

Discussion of the Related Art

With the development of information technologies, there are growing demands for display devices which are a medium for connecting a user to information. Accordingly, display devices, such as organic light-emitting displays (OLEDs), electrophoretic display devices (EDs), liquid crystal displays (LCDs), and plasma display panels (PDPs) are being used increasingly.

The organic light emitting display device includes a display panel having a plurality of sub-pixels, and a driver for driving the display unit. The driver includes a scan driver for providing a scan signal (or a gate signal), and a data driver for providing a data signal to the display panel.

If a scan signal or a data signal is provided to sub-pixels arranged in matrix, the organic light emitting display device may display an image such that a selected sub-pixel emits light.

A process for manufacturing a display panel includes a deposition process and a repair process. The deposition process is a process in which a conductive layer, a metal layer, an insulating layer, etc. are deposited on a substrate so as to form a substructure consisting of an element (including an electrode), a power line, a signal line, etc. The repair process is a process in which a defect detected in an inspection process is repaired or a defected sub-pixel is darkened.

A defect occurring in the process for manufacturing a display panel may be repaired in the repair process, for example, by darkening the defect. However, in the inspection process, it is impossible to detect a small substance, which has come inside during the process for manufacturing a display panel, or a growing defect which is a defect that gradually grows due to fragile structure. Thus, the conventional organic light emitting display device needs a solution for growing defects.

SUMMARY OF THE INVENTION

In one general aspect, the present disclosure provides an organic light emitting display device including a display panel, a data driver, and a scan driver. The display panel includes sub-pixels. The data driver supplies a data pixel to the sub-pixels. The scan driver supplies a scan signal for controlling a switching transistor of each sub-pixel, and a sensing signal for controlling a sensing transistor of each sub-pixel. The sensing transistor has a turn-on time for detecting whether a short has occurred between at least two electrodes of a switching transistor in response to a sensing signal.

In another general aspect, the present disclosure provides a driving method of an organic light emitting display device including an initialization step, a program step, a charging step, and a sensing step. The initialization step includes turning off a switching transistor, turning on a sensing transistor, and outputting a logic-high data signal and an initialization voltage. The program step includes turning on the switching transistor, turning off the sensing transistor, outputting the logic-high data signal, and stopping the output of the initialization voltage. The charging step includes turning off the switching transistor, turning on the sensing transistor, and stopping the output of the logic-high data signal and the initialization voltage so as to charge, in a sensing line, a voltage existing in a source node of a driving transistor. The sensing step includes turning off the switching transistor, turning on the sensing transistor, stopping the output of the logic-high data signal and the initialization voltage, and sensing a voltage charged in the sensing line.

BRIEF DESCRIPTION OF THE DRAWINGS

The accompanying drawings, which are included to provide a further understanding of the invention and are incorporated in and constitute a part of this specification illustrate embodiments of the invention and together with the description serve to explain the principles of the invention.

DETAILED DESCRIPTION OF THE EMBODIMENTS

Reference will now be made in detail embodiments of the invention examples of which are illustrated in the accompanying drawings.

Hereinafter, embodiments of the present disclosure will be described with reference to accompanying drawings.

An organic light emitting diode display according to an embodiment of the present disclosure is implemented as a television (TV), a video player, a Personal Computer (PC), a home theater, and a smart phone. The organic light emitting diode display described in the following performs an image display operation and an external compensation operation. The external compensation operation may be performed in a sub-pixel or pixel unit basis.

The external compensation operation may be performed in a vertical blank period during the image display operation, in a power-on sequence period before the image display operation, or in a power-off sequence period after the image display operation. The vertical blank period is a period of time in which a data signal for image display is not written, and each vertical blank period is a time between vertical active periods, wherein a data signal of one frame is written in each vertical active period. The power-on sequence period is a period of time which starts upon turning on power for driving the device and ends upon displaying an image. The power-off sequence period is a period of time which starts after displaying an image and ends upon turning off power for driving the device.

An external compensation method of performing the external compensation operation is sensing a voltage (a source voltage of a driving thin film transistor (TFT)) which is stored in a line capacitor (a parasite capacitor) of a sensing line after a driving transistor is driven in a source follower method. In order to compensate for a threshold voltage deviation of the driving transistor, the external compensation method senses a source voltage when a potential of a source node in the driving transistor enters a saturation state (that is, when a current Ids of the driving TFT becomes 0). In addition, in order to compensate for a mobility deviation of the driving transistor, the external compensation method senses a value of a linear state which is a state before the source node of the transistor enters the saturation state.

A TFT described in the following may be referred to as a source electrode and a drain electrode, or a drain electrode and a source electrode, except for a gate electrode. However, in order to avoid from being limited thereto, they will be described as a first electrode and a second electrode.

Figure 1:
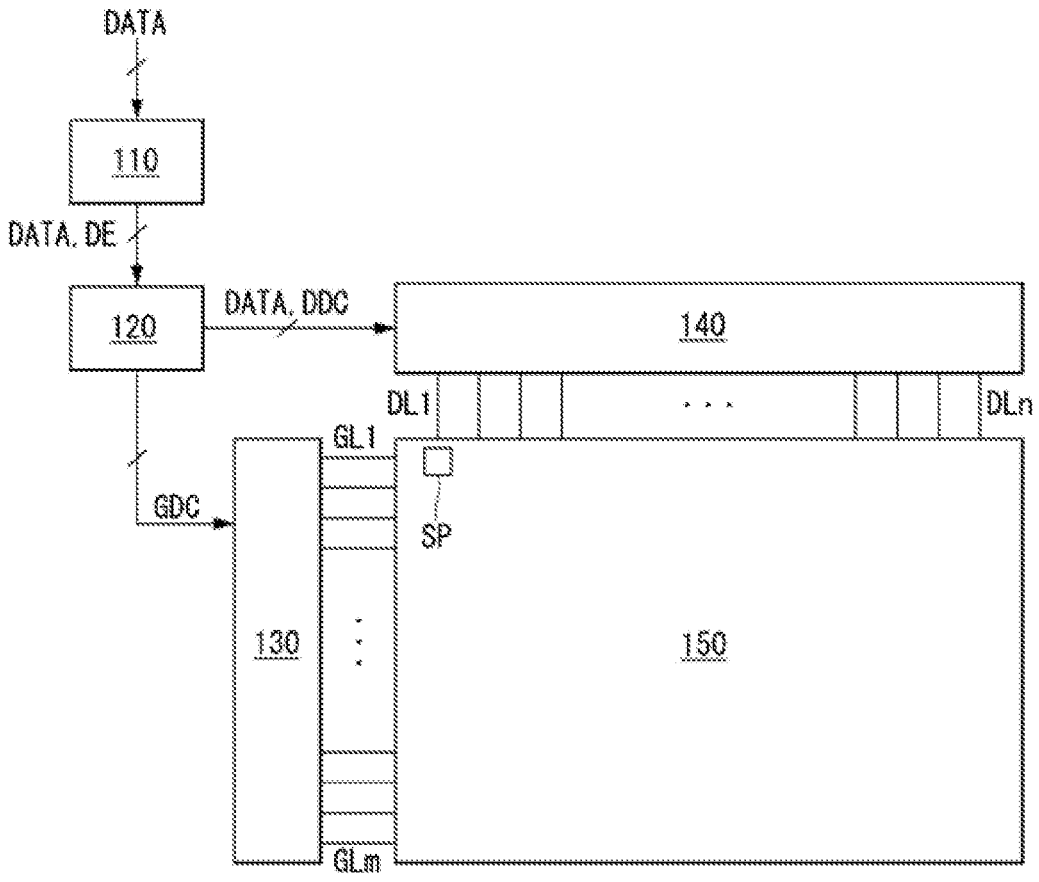
FIG. 1 is a schematic block diagram of an organic light emitting display device, according to an embodiment.
Figure 2:
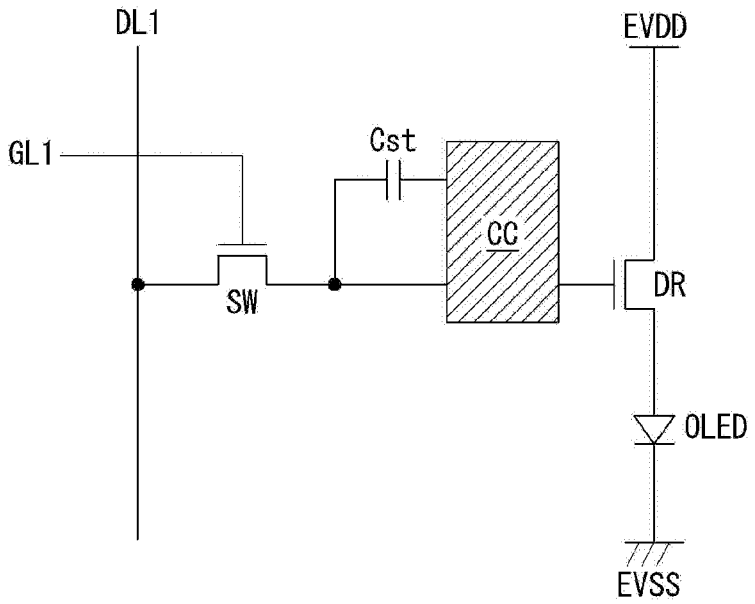
FIG. 2 is a schematic circuit of a sub-pixel, according to an embodiment.
Figure 3:
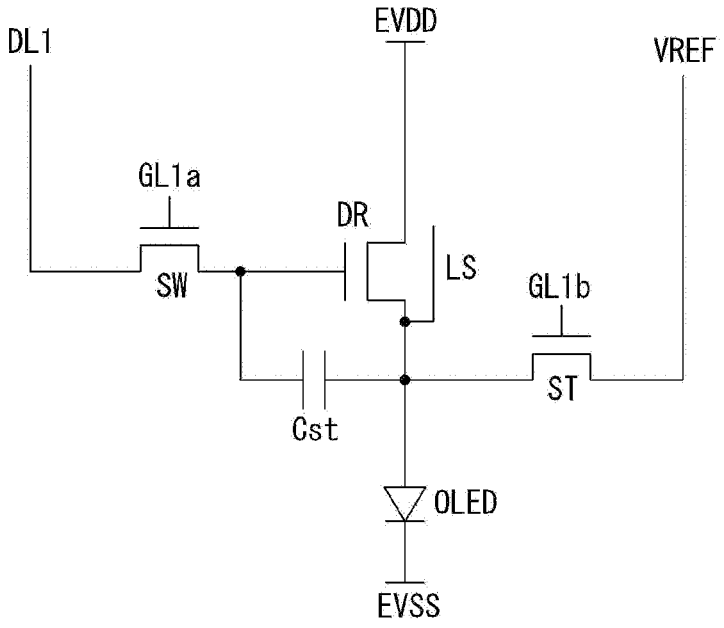
FIG. 3 is an example of a detailed circuit of a sub-pixel, according to an embodiment.
Figure 4:
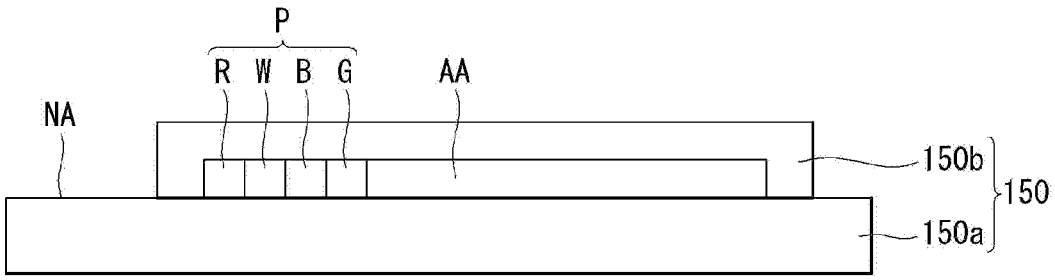
FIG. 4 is an example of a cross-sectional view of a display panel, according to an embodiment.
Figure 5:
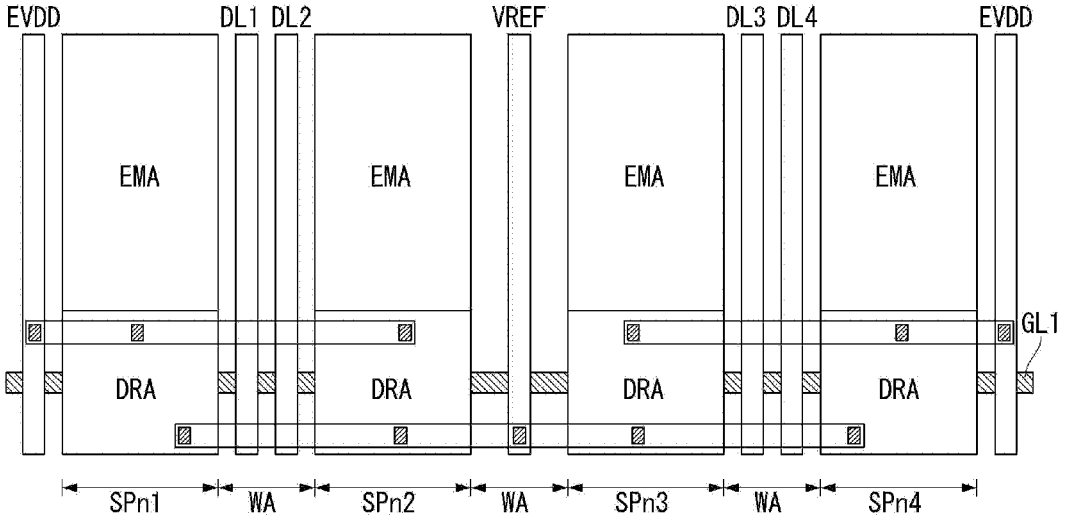
FIG. 5 is an example of a plane view of a sub-pixel, according to an embodiment.
Figure 6:
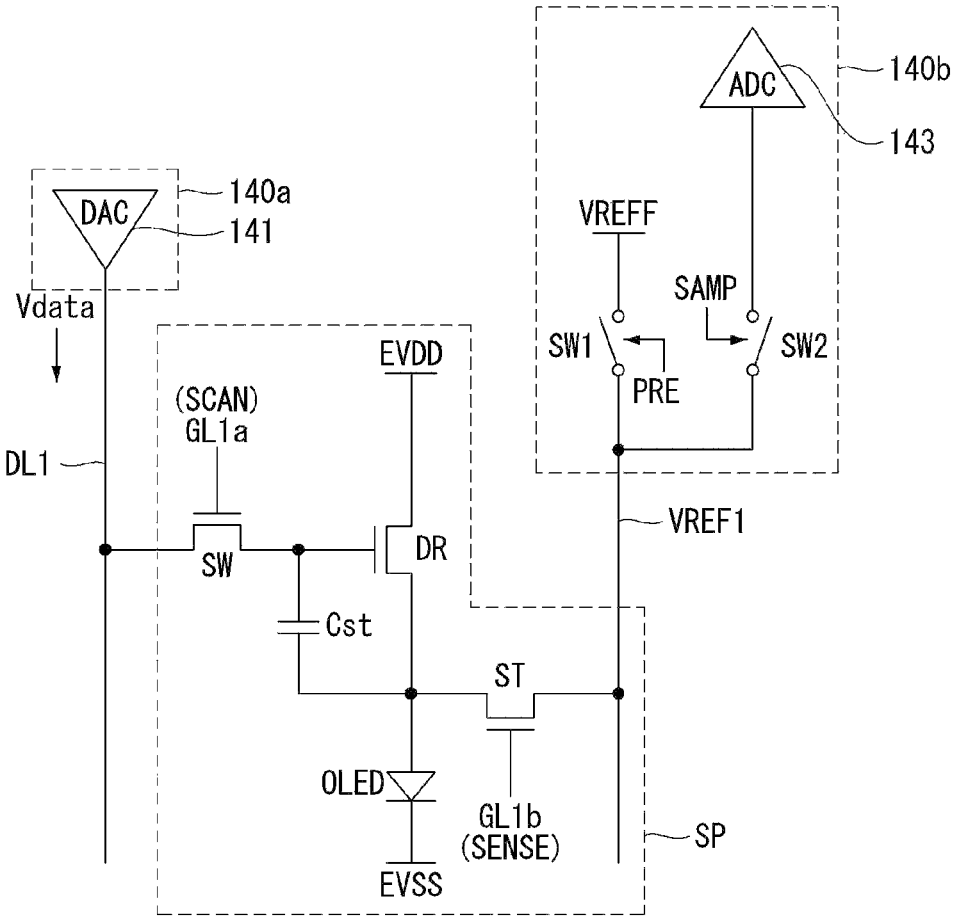
FIG. 6 is a schematic block diagram of a data driver including an external compensation circuit, according to an embodiment.
Figure 7:
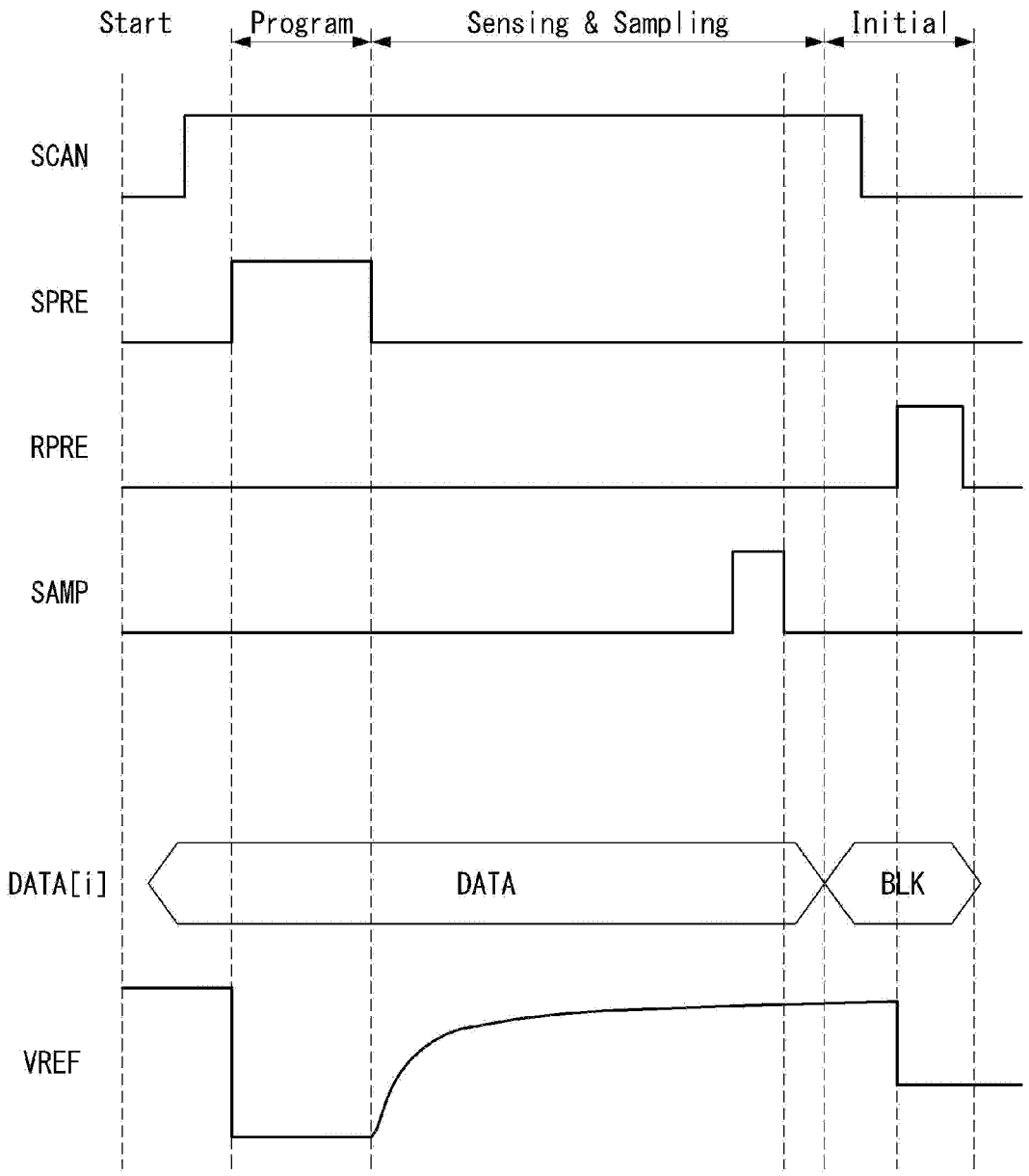
FIGS. 7 and 8 are examples of compensation waveforms for an external compensation operation, according to an embodiment.
Figure 8:
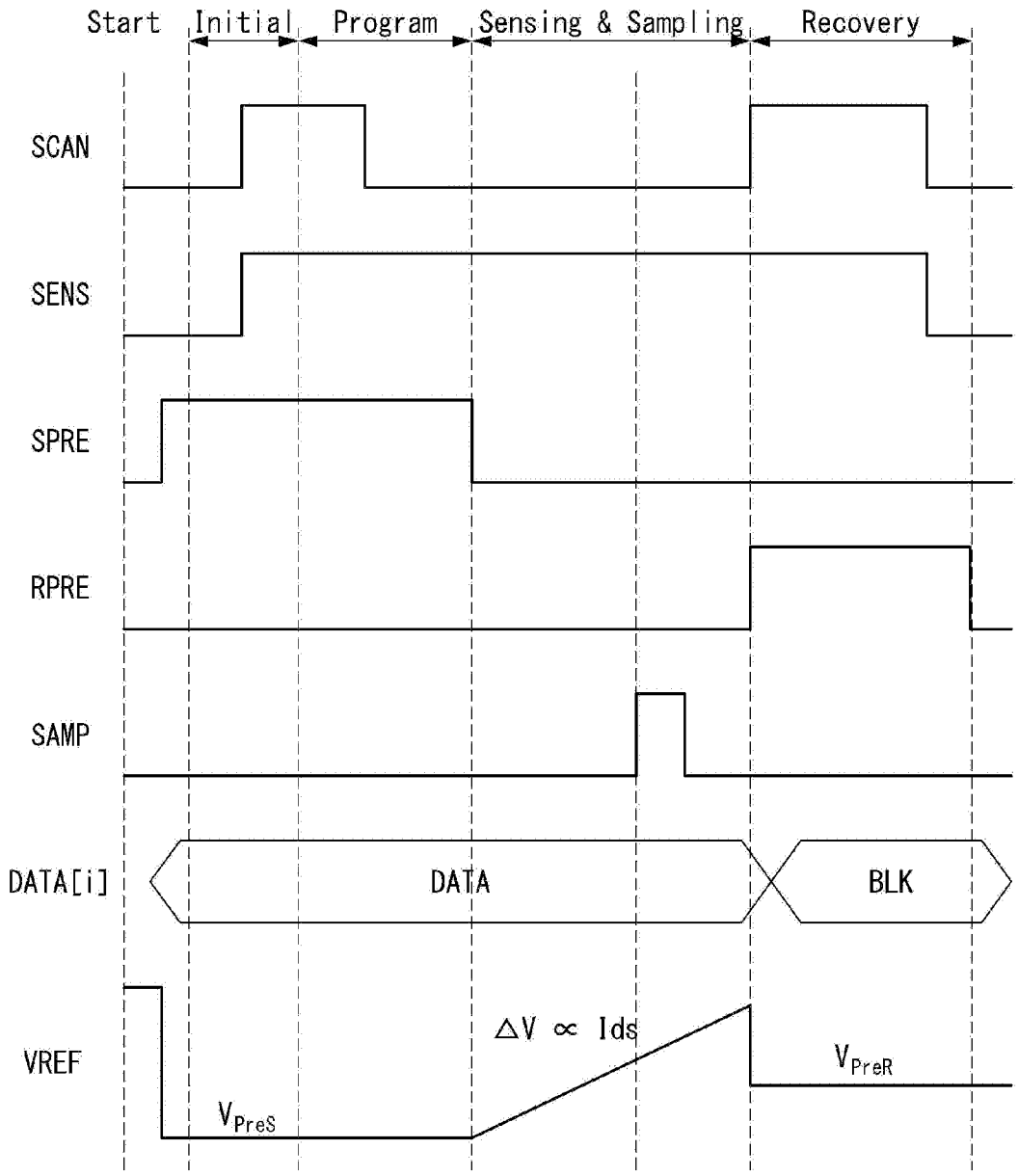

FIG. 1 is a schematic block diagram of an organic light emitting display device, FIG. 2 is a schematic circuit of a sub-pixel, FIG. 3 is an example of a detailed circuit of a sub-pixel, FIG. 4 is an example of a cross-sectional view of a display panel, FIG. 5 is an example of a plane view of a sub-pixel, FIG. 6 is a schematic block diagram of a data driver including an external compensation circuit, and FIGS. 7 and 8 are examples of compensation waveforms for an external compensation operation, according to an embodiment.

As illustrated in FIG. 1, an organic light emitting display device includes an image processing unit 110, a timing controller 120, a data driver 140, a scan driver 130, and a display panel 150.

The image processing unit 110 outputs a data enable signal DE in addition to a data signal DATA which is provided from the outside. The image processing unit 110 may output at least one of a vertical synchronization signal, a horizontal synchronization signal, and a clock signal, apart from the data enable signal DE, but those signals are omitted from the drawings for convenience of explanation.

The timing controller 120 is supplied from the image processing unit 110 with a data signal DATA in addition with a data enable signal DE and a driving signal, which includes a vertical synchronization signal, a horizontal synchronization signal, and a clock signal. Based on the driving signal, the timing controller 120 outputs a gate timing signal GDC for controlling operation timing of the scan driver 130, and a timing control signal DDC for controlling operation timing of the data driver 140.

In response to a data timing control signal DDC supplied from the timing controller 120, the data driver 140 may sample and latch a data signal supplied from the timing controller 120, convert the data signal DATA into a gamma reference voltage, and output the gamma reference voltage. The data driver 140 may output the data signal DATA via data lines DL1 to DLn. The data driver 140 may be in the form of an Integrated Circuit (IC).

In response to a timing control signal GDC supplied from the timing controller 120, the scan driver 130 may output a scan signal. The scan driver 130 may output a scan signal via scan lines GL1 to GLm. The scan driver 130 may be in the form of an IC or may be formed in a Gate-In-Panel (GIP) circuit on the display panel 150.

In response to a data signal DATA and a scan signal respectively supplied from the data driver 140 and the scan driver 130, the display panel 150 displays an image. The display panel 150 may include sub-pixels SP that operates to display the image.

The sub-pixels SP may include red sub-pixels, green sub-pixels, and blue sub-pixels, or may include white sub-pixels, red sub-pixels, green sub-pixels, and blue sub-pixels. The sub-pixels SP may have one or more different light emission areas depending on light emitting characteristics.

As illustrated in FIG. 2, a sub-pixel SP includes a switching transistor SW, a driving transistor DR, a capacitor Cst, a compensation circuit CC, and an organic light emitting diode (OLED).

In response to a scan signal supplied via a first scan line GL1, the switching transistor SW may perform a switching operation so that a data signal supplied via a first data line DL1 is stored in the capacitor Cst as a data voltage. According to the data voltage stored in the capacitor Cst, the driving transistor DR allows a driving current to flow between a first power line EVDD and a second power line EVSS. According to the driving current formed by the driving transistor DR, the OLED emits light.

The compensation circuit CC is a circuit that is added to a sub-pixel SP in order to compensate for a threshold voltage of the driving transistor DR. The compensation circuit CC is composed of one or more transistors. The configuration of the compensation circuit CC may vary depending on an external compensation method, and examples thereof are as follows.

As illustrated in FIG. 3, the compensation circuit CC includes a sensing transistor ST and a sensing line VREF (or a reference line). The sensing transistor ST is connected between a source node of the driving transistor DR and an anode electrode of the OLED (which is hereinafter referred to as a sensing node). The sensing transistor ST supplies an initialization voltage (or a sensing voltage), transferred via the sensing line VREF, to the source node of the driving transistor DR (or a sensing node), or senses a voltage or current of the source node of the driving transistor DR.

The switching transistor SW includes a first electrode connected to the first data line DL1, and a second electrode connected to a gate electrode of the driving transistor DR. The driving transistor DR includes a first electrode connected to the first power line EVDD, and a second electrode connected to the anode electrode of the OLED. The capacitor Cst includes a first electrode connected to the gate electrode of the driving transistor DR, and a second electrode connected to the anode electrode of the OLED. The OLED includes an anode electrode connected to the second electrode of the driving transistor, and a cathode electrode connected to the second power line EVSS. The sensing transistor ST includes a first electrode connected to the sensing line VREF, and a second electrode connected to the anode electrode of the OLED, which is a sensing node, and to the second electrode of the driving transistor DR.

An operation time of the sensing transistor ST may be similar or identical to that of the switching transistor SW depending on an external compensation algorithm (or the configuration of the compensation circuit). For example, the switching transistor SW may include an electrode connected to a first scan line A GL1*a*, and the sensing transistor ST may include a gate electrode connected to a first scan line B GL1*b*. In another example, the first scan line A GL1*a* connected to the gate electrode of the switching transistor SW and the first scan line B GL1*b* connected to the gate electrode of the sensing transistor ST may be connected for sharing.

The sensing line VREF may be connected to the data driver 140. In this case, the data driver 140 is able to sense a sensing node of a sub-pixel SP and generate a sensing result only in a non-display period of an image or in a period of N frames (N is an integer equal to or greater than 1). Meanwhile, the switching transistor SW and the sensing transistor ST may be turned on at the same time. In this case, a sensing operation through the sensing line VREF and a data output operation for outputting a data signal are separate (distinguished) from each other by a time division method of the data driver 140.

In addition, compensation can be also determined for a sensing result such as a data signal in a digital format, a data signal in an analog format, or a gamma signal. In addition, a compensation circuit for generating a compensation signal (or a compensation voltage) based on a sensing result may be included in the data driver 140 or the timing controller 120, or may be implemented as a separate circuit from the data driver 140 or the timing controller 120.

A light shield layer LS may be disposed below a channel region of the driving transistor DR, or may be arranged not just below the channel region of the driving transistor DR, but also below channel regions of the switching transistor SW and the sensing transistor ST. The light shield layer LS may be used simply to shield external light, or may be used as an electrode for achieving connection with another electrode or line and for constructing a capacitor.

FIG. 3 shows an example of a sub-pixel SP which is in the structure of 3T (Transistor) 1C (Capacitor) that includes a switching transistor SW, a driving transistor DR, a capacitor Cst, an OLED, and a sensing transistor ST. However, if the sub-pixel SP includes a compensation circuit CC, the sub-pixel SP may be in the structure of 3T2C, 4T2C, 5T1C, or 6T2C.

As illustrated in FIG. 4, sub-pixels are formed on a display area AA of a first substrate (or a TFT substrate) 150*a* based on the circuit described with reference to FIG. 3. The sub-pixels formed on the display area AA are sealed by a protection film (or a protection substrate) 150*b*. NA not described above indicates a non-display area. The first substrate 150*a* may be formed of glass or a flexible material.

The sub-pixels SP are horizontally or vertically arranged in the order of a red sub-pixel R, a white sub-pixel W, a blue sub-pixel B, and a green sub-pixel G. In addition, the red sub-pixel R, the white sub-pixel W, the blue sub-pixel B, and the green sub-pixel G compose one pixel P. The arrangement order of the sub-pixels may be changed depending on a light emission material, a light emission area, or the configuration (or structure) of a compensation circuit. In addition, a red sub-pixel R, a blue sub-pixel B, and a green sub-pixel may compose one pixel P.

As illustrated in FIGS. 4 and 5, a first sub-pixel SPn1 to a fourth sub-pixel SPn4 each having an emission area EMA and a circuit area DRA are formed on a display area AA of the first substrate 150*a*. An OLED is formed in the light emission area EMA, and TFTs including switching and driving transistors are formed in the circuit area DRA. Elements formed in the light emission area EMA and the circuit area DRA are formed by a process of depositing a plurality of metal layers and a plurality of insulating layers.

In response to operation of the switching and driving transistors located in the circuit area DRA, an OLED located in the light emission area EMA of each of the first sub-pixel SPn1 to the fourth sub-pixel SPn4 emits light. "WA" located between the first sub-pixel SPn1 to the fourth sub-pixel SPn4 is a wire area in which a power line or a data line is arranged.

The first power line EVDD may be located on the left side of the first sub pixel SPn1, the sensing line VREF may be located on the right side of a second sub-pixel SPn2, and first and second data lines DL1 and DL2 may be located between the first sub-pixel SPn1 and the second sub-pixel SPn2.

The sensing line VREF may be located on the left side of a third sub-pixel SPn3, the first power line EVDD may be located on the right side of the fourth sub-pixel SPn4, and third and fourth data lines DL3 and DL4 may be located between the third sub-pixel SPn3 and the fourth sub-pixel SPn4.

The first sub-pixel Spn1 may be electrically connected to the first power line EVDD located on its left side, to the first data line DL1 located on its right side, and to the sensing line VREF located on the right side of the second sub-pixel SPn2. The second sub-pixel SPn2 may be electrically connected to the first power line EVDD located on the left side of the first sub-pixel SPn1, to the second data line DL2 located on its left side, and to the sensing line VREF located on its right side.

The third sub-pixel SPn3 may be electrically connected to the sensing line VREF located on its left side, to the third data line DL3 connected to its right side, and to the first power line EVDD located on the right side of the fourth sub-pixel SPn4. The fourth sub-pixel SPn4 may be electrically connected to the sensing line VREF located on the left side of the third sub-pixel SPn3, to the fourth data line DL4 located on its left side, and to the first power line EVDD located on its right side.

The first sub-pixel SPn1 to the fourth sub-pixel Spn4 may be shared by (or mutually connected to) the sensing line VREF located between the second sub-pixel SPn2 and the third sub-pixel SPn3, but aspects of the present disclosure are not limited thereto. In addition, the scan line GL1 is depicted as a single line, but aspects of the present disclosure are not limited thereto.

In addition, not only lines such as the first power line EVDD and the sensing line VREF, but also electrodes of a TFT are located on different layers, and are electrically connected as contacting one another through a contact hole (via hole). The contact hole is formed in a dry or wet etching process so as to expose some of the electrodes, a signal line, or a power line located below the contact hole.

As illustrated in FIG. 6, the data driver 140 includes a first circuit 140*a* for outputting a data signal to a sub-pixel SP, and a second circuit 140*b* for sensing the sub-pixel SP to compensate for a data signal.

The first circuit 140*a* includes a digital-analog conversion (DAC) circuit 141 that is capable of converting a digital data signal into an analog data signal VDATA and output the analog data signal VDATA. An output stage of the first circuit 140*a* is connected to the first data line DL1.

The second circuit 140*b* includes a voltage output circuit SW1, a sampling circuit SW2, and an analog-digital conversion (ADC) circuit 143. The voltage output circuit SW1 operates in response to a charge signal control PRE. The sampling circuit SW2 operates in response to a sampling control signal SAMP.

The voltage output circuit SW1 is configured to output a first initialization voltage, generated by a voltage source VREFF, via the first sensing line VREF1 and a second initialization voltage via the first data line DL1. The first initialization voltage, generated by the voltage source VREFF, and the second initialization voltage may be generated as a voltage between a first power voltage and a second power voltage.

The first initialization voltage and the second initialization voltage may be set as a similar or identical voltage. The first initialization voltage may be set to a voltage close to a ground level in order to be used for external compensation of a display panel, and the second initialization voltage may be set to be higher than the first initialization voltage in order to be used for normal operation of the display panel. The voltage output circuit SW1 operates only when outputting the first initialization voltage and the second initialization voltage. The voltage output circuit SW1 is depicted as having a switch SW1 and the voltage source VREFF, but aspects of the present disclosure are not limited.

The sampling circuit SW2 may sense the sub-pixel SP using the first sensing line VREF1. The sampling circuit SW2 senses a threshold voltage of the OLED and a threshold voltage or mobility of the driving transistor DR in a sampling method, and then transmits a sensing value to the ADC circuit 143. The sampling circuit SW2 is depicted as a switch SW2. However, aspects of the present disclosure are not limited thereto, and the sampling circuit SW2 may be implemented as an active device and a passive device.

The ADC circuit 143 receives a sensing value from the sampling circuit SW2, and converts an analog voltage value into a digital voltage value. The ADC circuit 143 outputs a sensing value which is converted into a digital value. The sensing value output from the ADC circuit 143 is supplied to a circuit necessary to generate a compensation value. For example, a threshold voltage of the driving transistor DR is detected during a period in which a black data signal is applied (or during a turn-on time of a device). When the threshold voltage is changed, a compensation value is generated such that the threshold voltage is a before-change value (or a normal value).

Hereinafter, an exemplary waveform for sensing a threshold voltage and mobility of the driving transistor DR is described as an example of an external compensation operation. However, the waveform described in the following is merely an example for explaining a sensing operation, and aspects of the present disclosure are not limited thereto.

As illustrated in FIGS. 6 and 7, in order to sense a threshold voltage of the driving transistor DR, the compensation circuit performs operations, such as program, sensing & sampling, and initialization.

The scan signal SCAN is a signal for controlling the switching transistor SW. When the scan signal SCAN becomes logic high, the switching transistor SW is turned on. When the scan signal SCAN becomes logic low, the switching transistor SW is turned off. The scan signal SCAN is maintained at logic high during the period from Program to Sensing & Sampling.

The charge control signal SPRE and RPRE is a signal for controlling the voltage output circuit SW1. When a first charge control signal SPRE becomes logic high, a first initialization voltage is output. When a second charge control signal RPRE becomes logic high, a second initialization is output. The first charge control signal SPRE is maintained at logic high during the Program period. The second charge control signal RPRE is maintained logic high only during the Initialization period.

The sampling control signal SAMP is a signal for controlling the sampling circuit SW2. When the sampling control signal SAMP becomes logic high, the sampling circuit SW2 performs sampling for a sensing operation. When the sampling control signal SAMP becomes logic low, the sampling circuit SW2 stops sensing. The sampling control signal SAMP is temporarily maintained at logic high at the end of the Sensing & Sampling period.

The data driver 140 outputs a data signal DATA during the Program period and the Sensing & Sampling period, and outputs a black data signal BLK during the Initialization period.

Due to the above operation, a voltage by which a threshold voltage of the driving transistor DR can be sensed exists in the sensing line VREF. The sampling circuit SW2 senses a voltage in the sensing line VREF during the Sensing & Sampling period.

As illustrated in FIGS. 6 and 8, in order to sense mobility of the driving transistor DR, the compensation circuit performs operations of initialization, program, sensing & sampling, and recovery.

A scan signal SCAN is a signal for controlling the switching transistor SW. The switching transistor SW is turned on when the scan signal SCAN becomes logic high. The switching transistor SW is turned off when the scan signal SCAN becomes logic low. The scan signal SCAN is maintained at logic high in the initialization period and the program period. In addition, the scan signal SCAN is maintained at logic high in the recovery period.

A sensing signal SENS is a signal for controlling the sensing transistor ST. The sensing transistor ST is turned on when the sensing signal SENS logic high. The sensing Transistor ST is turned off when the sensing signal SENS becomes logic low. The sensing signal SENS is maintained at logic high in the initialization period, the program period, the sensing & sampling period, and the recovery period.

A charge control signal SPRE and RPRE is a signal for controlling for the voltage output circuit SW1. The voltage output circuit SW1 outputs a first initialization voltage when a first control charge signal SPRE becomes logic high. The voltage output circuit SW1 outputs a second initialization voltage when a second charge control signal RPRE becomes logic high. The first charge control signal SPRE is maintained at logic high in the initialization period and the program period. The second charge control signal RPRE is maintained at logic high in the recovery period.

A sampling control signal SAMP is a signal for controlling the sampling circuit SW2. The sampling circuit SW2 performs sampling for a sensing operation when the sampling control signal SAMP, whereas the sampling circuit SW2 stops the sensing operation when the sampling control signal SAMP becomes logic low. The sampling control signal SAMP is temporarily maintained at logic high at the end of the sensing & sampling period.

The data driver 140 outputs a data signal DATA in the program period and the sensing & sampling period, and outputs a black data signal BLK in the initialization period.

Due to the above operation, a current ($\Delta V \propto Ids$) by which mobility of the driving transistor DR is sensed exists in the sensing line VREF. The sampling circuit SW2 senses the current in the sensing line VREF during the Sensing & Sampling period.

Meanwhile, a display panel is gradually implemented with a large screen and high resolution. Accordingly, a more number of metal layers and insulating layers is formed on a substrate of the display panel. In addition, a design layout of the substrate is becoming more complex. Furthermore, due to a foreign substance or byproducts generated in the process of manufacturing a display panel, a probability of occurrence of a short increases.

In order to address and avoid this problem and increase a production yield of display panels, a deposition process and a repair process are performed for manufacturing display panels. The deposition process is a process in which a conductive layer, a metal layer, and an insulating layer are deposited on a substrate so as to form a structure consisting of an element (including an electrode), a power line, and a signal line. The repair process is a process for repairing an error detected in an inspection process or darkening a defected sub-pixel.

A defect occurring in the process for manufacturing a display panel may be repaired by the repair process, for example, darkening a defect pixel. However, in the inspection process, it is impossible to detect a small substance, which has come inside during the process for manufacturing a display panel, or a growing defect which is a defect that gradually grows due to fragile structure.

The following description is to look into a growing defect that can possibly occur in an experimental example, and an embodiment in which the growing defect can be addressed will be described. However, aspects of the present disclosure are not limited to the following experimental example and embodiments.

EXPERIMENTAL EXAMPLE

Figure 9:
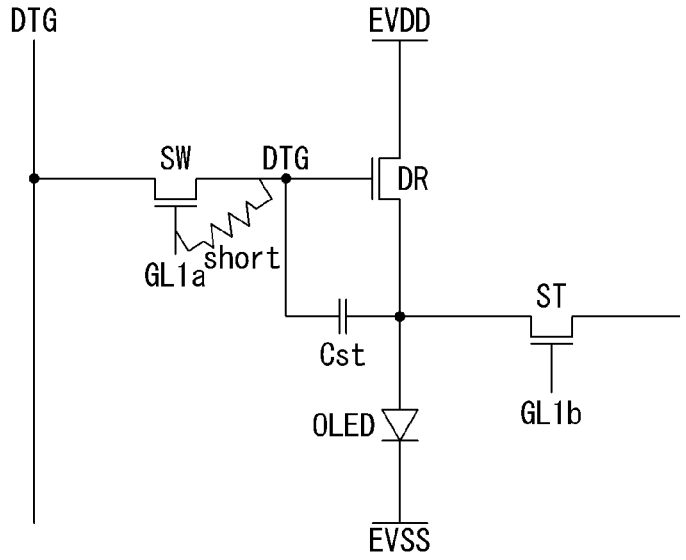
FIG. 9 is an example of a sub-pixel according to an experimental example.
Figure 10:
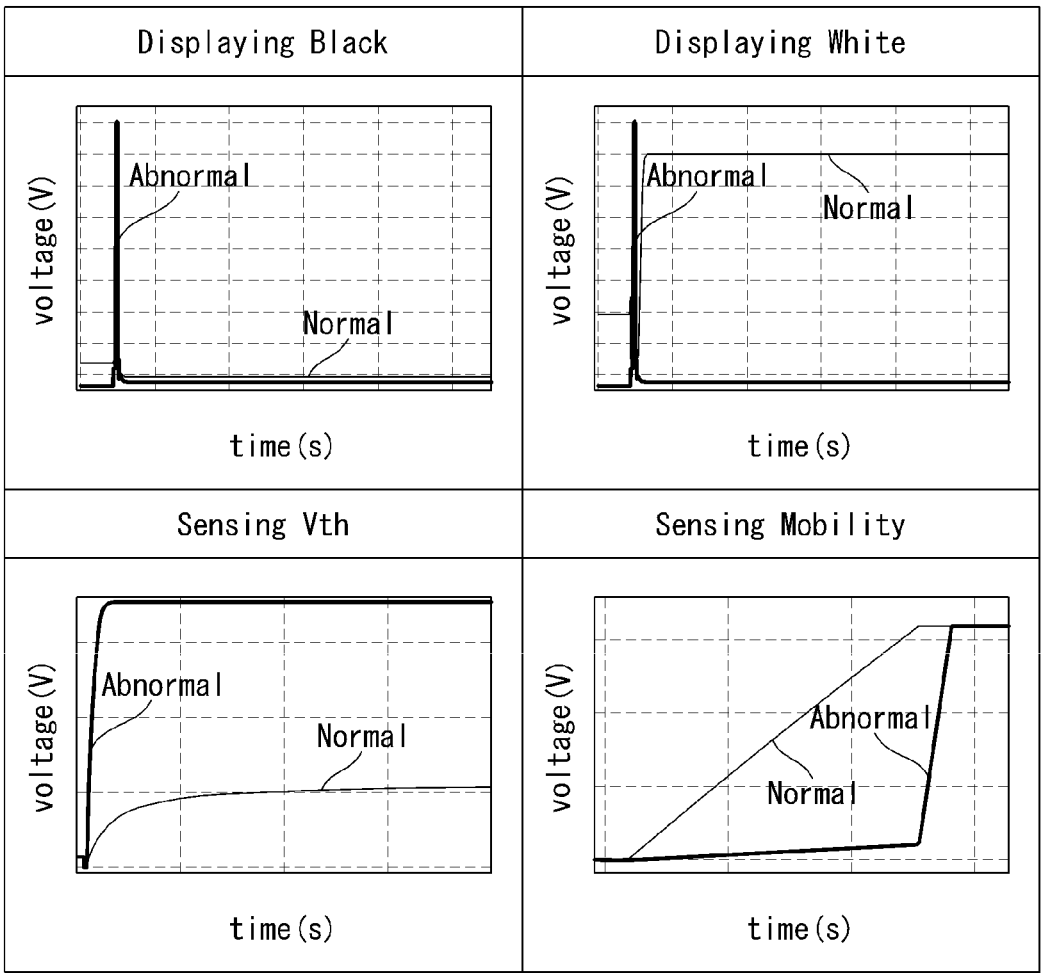
FIG. 10 is a diagram for explanation of a problem caused by a growing defect.

FIG. 9 is an example of a sub-pixel according to an experimental example, and FIG. 10 is a diagram for explanation of a problem caused by a growing defect.

FIG. 9 shows a case in which a short between the gate electrode and the second electrode of the switching transistor SW occurs due to a growing defect. The gate electrode of the switching transistor SW is connected to the first scan line A GL1*a*, and the second electrode of the switching transistor SW is connected to the gate electrode of the driving transistor DR.

A scan signal provided via the first scan line A GL1*a* temporarily becomes logic high in a period of one frame in order to transfer a data signal to a sub-pixel SP, and then maintained at logic low until the next frame comes.

Meanwhile, when a short occurs between the gate electrode and the second electrode of the switching transistor SW, not just the gate electrode of the driving transistor DR but the second electrode thereof is affected. As a result, an error occurs not just in a period for displaying an image on a display panel, but in a period for external compensation, and this will be described as follows.

As illustrated in FIGS. 9 and 10, when there is no short between the gate electrode and the second electrode of the switching transistor SW (normal state), black is normally displayed on the display panel. However, when there is a short between the gate electrode and the second electrode of the switching transistor SW (abnormal state), black is not normally displayed on the display panel.

To display black, a data signal needs to have a low voltage level. Yet, if a short occurs between the gate electrode and the second electrode of the switching transistor SW, a logic-high scan signal affects the data signal for displaying black, and therefore, white is displayed temporarily (see an impulse-type waveform in FIG. 10). As a result, an image with little luminance is temporarily displayed in the display panel with a weak luminance.

For a similar reason, when there is no short between the gate electrode and the second electrode of the switching transistor SW (normal state), white is normally displayed on the display panel. However, when there is a short between the gate electrode and the second electrode of the switching transistor SW, white is not normally displayed on the display panel. This problem occurs even when a grayscale other than white is displayed in the display panel. For example, a dark spot may occur when a full grayscale is displayed on the display panel.

When there is no short between the gate electrode and the second electrode of the switching transistor SW (normal state), a threshold voltage Vth of the driving transistor is normally sensed. However, when there is a short between the gate electrode and the second electrode of the switching transistor SW (abnormal state), a threshold voltage of the driving transistor is not normally sensed. In the abnormal state, a higher voltage is sensed as compared to the normal state.

When there is no short between the gate electrode and the second electrode of the switching transistor SW (normal state), mobility of the driving transistor is normally sensed. However, when there is a short between the gate electrode and the second electrode of the switching transistor SW (abnormal state), mobility of the driving transistor is not normally sensed. In the normal state, a sensing voltage linearly increases due to effects of a constant current. However, in the abnormal state, a sensing voltage dramatically increases at a certain point.

As above, if a growing defect is not detected in an inspection process, an error occurs not just in a period for displaying an image but a period for external compensation. Thus, it is required to solve these problems.

Embodiment

Figure 11:
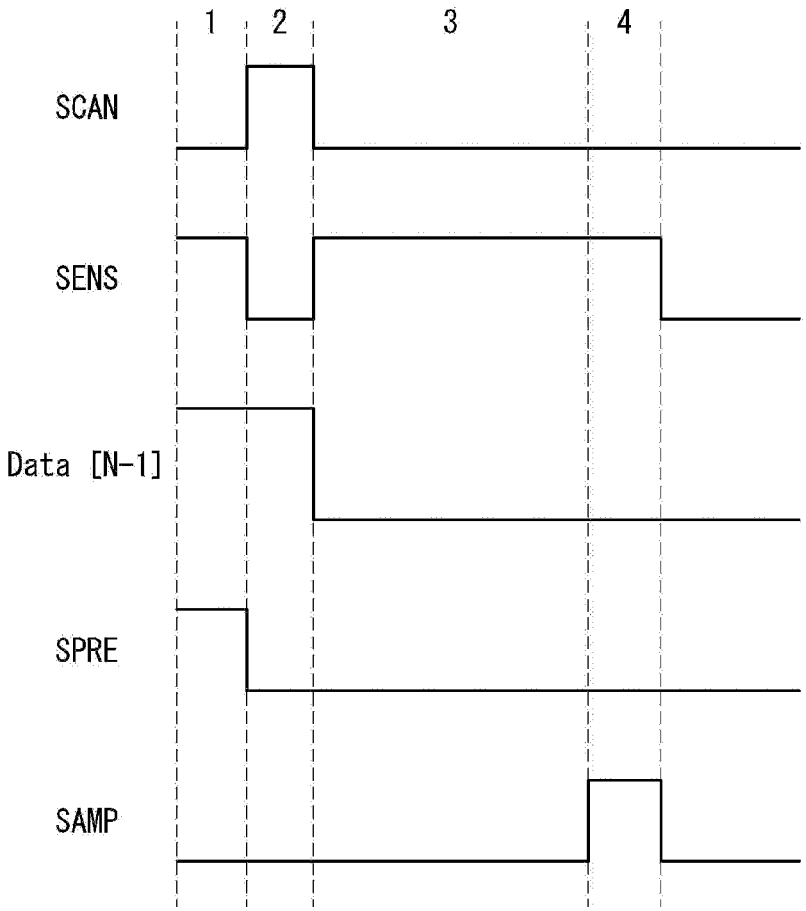
FIG. 11 is a waveform for explanation of a short detection method of according to an embodiment.
Figure 16:
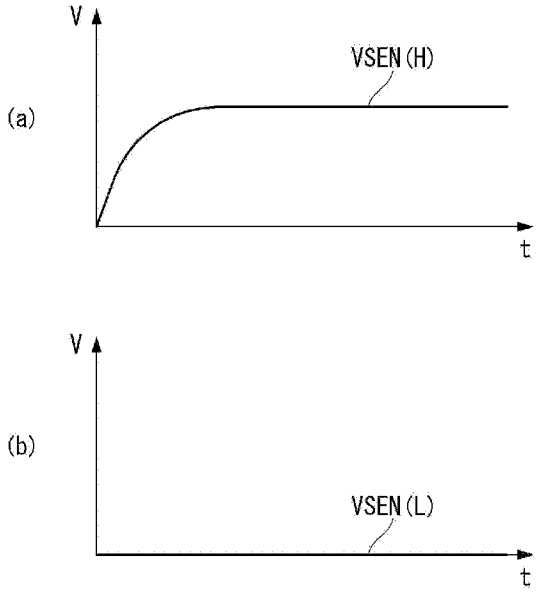
FIG. 16 is a diagram illustrating a sensing voltage according to a state of a switching transistor, according to an embodiment.
Figure 17:
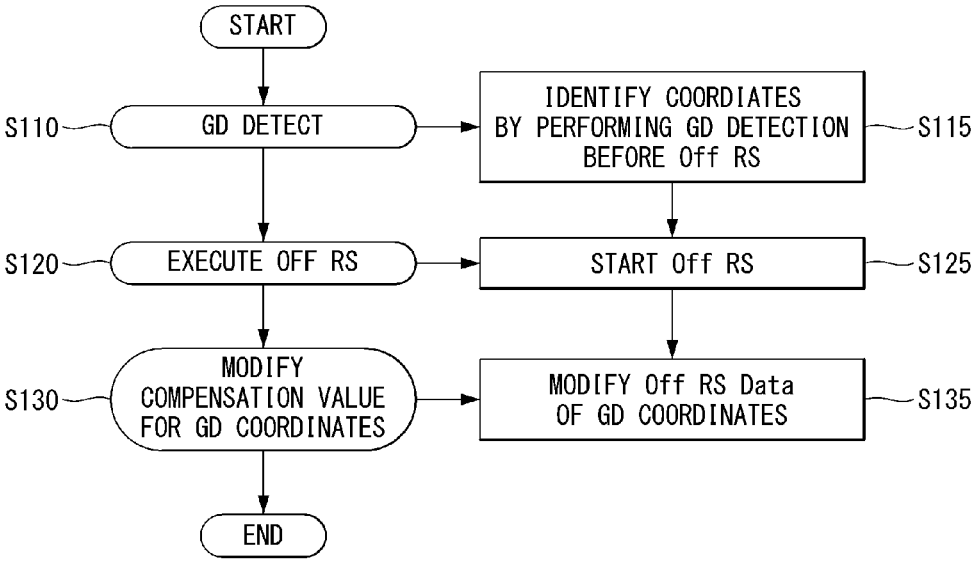
FIG. 17 is a flowchart for explanation of a compensation method depending on presence or absence of a short, according to an embodiment.

FIG. 11 is a waveform for explanation of a short detection method according to an embodiment. FIGS. 12 to 15 are diagrams for explanation of each step of a short detection operation, shown in FIG. 11. FIG. 16 is a diagram illustrating a sensing voltage according to a state of a switching transistor. FIG. 17 is a flowchart for explanation of a compensation method depending on presence or absence of a short, according to an embodiment.

As illustrated in FIG. 11, a short detection method according to an embodiment includes an initialization period 1, a program period 2, a charging period 3, and a sensing period 4.

A scan signal SCAN is maintained at logic high in the program period 2, while being maintained at logic low in the initialization period 1, the charging period 3, and the sensing period 4. A sensing signal SENS is maintained at logic low in the program period 2, while being maintained at logic high in the initialization period 1, the charging period 3, and the sensing period 4. A first charge control signal SPRE is maintained at logic high in the initialization period 1, while being maintained at logic low in the program period 2, the charging period 3, and the sensing period 4. A sampling control signal SAMP is maintained at logic high in the sensing period 4, while being maintained at logic low in the initialization period 1, the program period 2, and the charging period 3.

Figure 12:
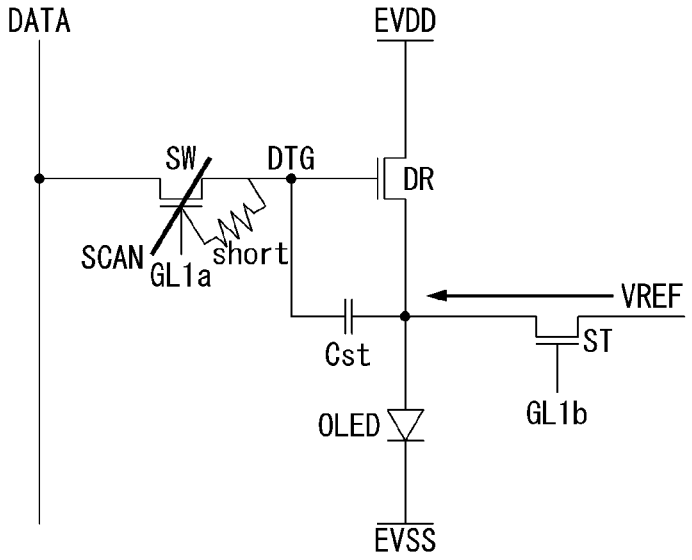
FIGS. 12 to 15 are diagrams for explanation of each step of a short detection operation, shown in FIG. 11.

As illustrated in FIGS. 11 and 12, the switching transistor SW is turned off and the sensing transistor ST is turned on in the initialization period 1. The data driver outputs a data signal DATA [N−1] (or a logic-high data signal). As the first charge control signal SPRE becomes logic high, an initialization voltage is transferred to a source node of the driving transistor DR via the sensing transistor ST. As a result, a source node (or a sensing node) of a sub-pixel SP shown in FIG. 12 is initialized by the initialization voltage.

Figure 13:
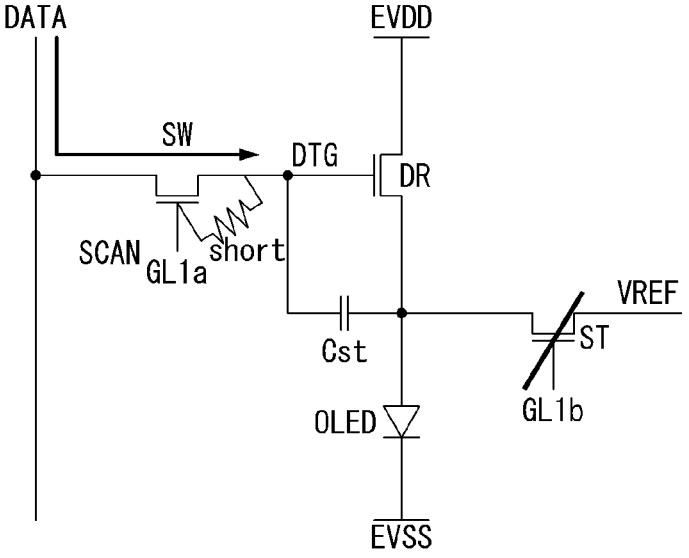

As illustrated in FIGS. 11 and 13, the switching transistor SW is turned on and the sensing transistor ST is turned off in the program period 2. The data driver keeps outputting the data signal DATA[N−1]. As the scan signal SCAN becomes logic high, the data signal DATA[N−1] is transferred to the capacitor Cst. As a result, the capacitor Cst of the sub-pixel SP shown in FIG. 12 is programmed by the data signal.

Figure 14:
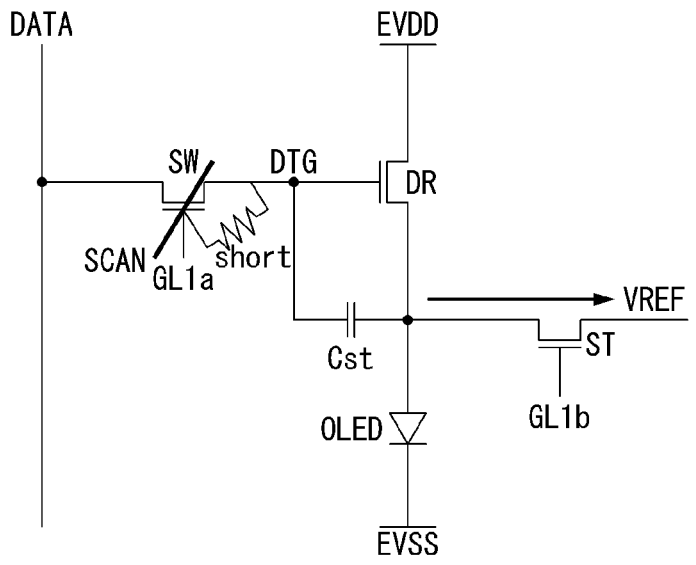

As illustrated in FIGS. 11 and 14, the switching transistor SW is turned off and the sensing transistor ST is turned on in the charging period 3. The data driver stops outputting the data signal DATA [N−1]. As the sensing signal SENS becomes logic high, the sensing transistor ST is turned on and a voltage existing in the source node of the driving transistor DR is charged in the sensing line VREF.

Figure 15:
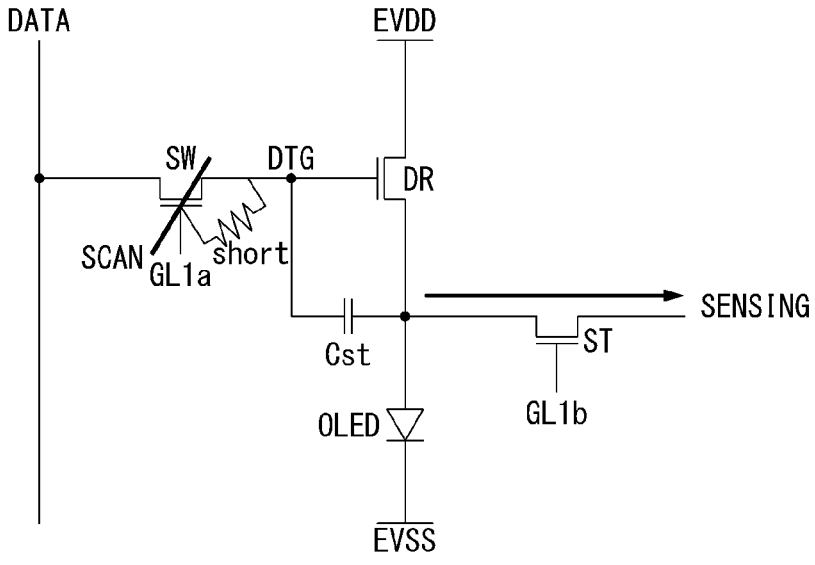

As illustrated in FIGS. 11 and 15, the switching transistor SW is turned off and the sensing transistor ST is tuned off during the sensing period 4. As the sampling control signal SAMP becomes logic high, a voltage charged in the sensing line VREF may be sensed by a sampling circuit.

As illustrated in FIGS. 11 and 16, in the normal state of the switching transistor SW included in a sub-pixel (which means when there is no short), a logic-high voltage VSEN (H) is sensed. On the other hand, in the abnormal state of the switching transistor SW included in a sub-pixel (which means when there is a short, a logic-low voltage VSEN(L) is sensed.

According to the above description, the embodiment is able to detect a subpixel in which a short occurs between a gate electrode and a second electrode (or a drain electrode) of the switching transistor SW. It is because a logic-low voltage VSEN(L) is sensed when a short occurs between the gate electrode and the second electrode (or the drain electrode) of the switching transistor SW.

Similar to an external compensation operation, the embodiment may be performed in a vertical blank period during an image display operation (in real-time), in a power-sequence period before image display, or in a power-off period after image display. However, during a short detection operation for detecting a sub-pixel in which a short has occurred, an external compensation operation is stopped and replaced by the short detection operation. The following description is provided regarding an example in which a short detection operation is performed in the power-off sequence period.

As illustrated in FIG. 17, short detection GD Detect is performed in S110. The short detection operation includes performing short detection GD Detect before a power-off sequence Off RS, and identify coordinates of a sub-pixel including a switching transistor in which the short occurs in S115. The short detection operation may be performed on a sub-pixel or pixel unit basis.

The power-off sequence Off RS is executed in S120. When the power-off sequence Off RS is executed, a power-off sequence Off RS for performing external compensation starts in S125. Description about the external compensation is provided with reference to FIGS. 6 and 8.

Coordinates of a sub-pixel including the switching transistor GD in which a short has occurred are identified, and a compensation value is modified in S130. When the coordinates of the sub-pixel including the switching transistor GD in which a short has occurred are completely identified, power-off sequence data Off RS Data of the sub-pixel are modified in S135.

The short detection method according to an embodiment accompanies a compensation method in which a sub-pixel having a switching transistor GD, in which a short has occurred, is detected, and a compensation value of the detected sub-pixel is modified or adjusted. In addition, the short detection method according to an embodiment accompanies a compensation method in which a compensation value is modified based on coordinates of an abnormal (defected) sub-pixel, so that darkening of a normal sub-pixel in surroundings of the abnormal sub-pixel is prevented. In addition, if a subpixel having a switching transistor GD in which a short has occurred is a white sub-pixel, compensation may be done in a manner in which operation of the sub-pixel is stopped (or turned off).

Figure 18:
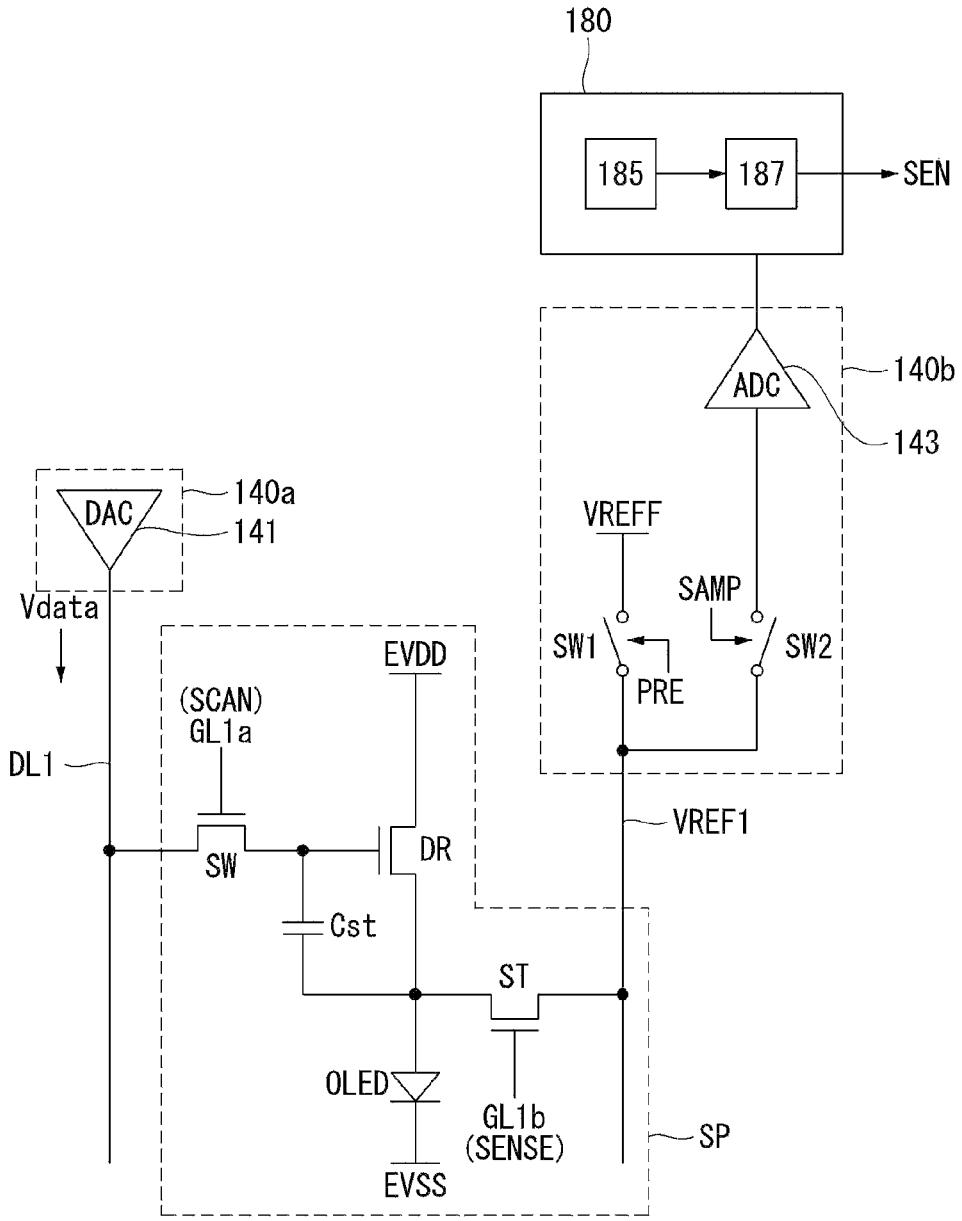
FIG. 18 is a schematic block diagram of a data driver, which including a short detection circuit and an external compensation circuit, and a data compensation unit according to an embodiment.
Figure 19:
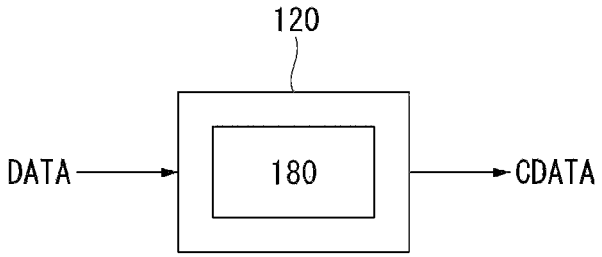
FIG. 19 is a schematic block diagram of a timing controller including a data compensation unit, according to an embodiment.

FIG. 18 is a schematic block diagram of a data driver, which includes a short detection circuit and an external compensation circuit, and a data compensation unit according to an embodiment. FIG. 19 is a schematic block diagram of a timing controller including a data compensation unit, according to an embodiment.

As illustrated in FIG. 18, a data driver 140*a* and 140*b*, which includes a short detection circuit and an external compensation circuit, interworks with a compensation driver 180. The compensation driver 180 performs short detection and external compensation based on a sensing value in the digital format transferred from a second circuit 140*b* of the data driver 140*a* and 140*b*.

Based on a sensing value, the compensation driver 180 generates a compensation value necessary for short detection and external compensation, or may modify or adjust a compensation value. The compensation driver 180 includes a determination unit 185 and a compensation value generation unit 187.

Based on a sensing value, the determination unit 185 determines whether a short has occurred or whether external compensation has been performed. Depending on whether a short has occurred or whether external compensation has been performed, the compensation value generation unit 187 generates a compensation value SEN for each subpixel of the display panel. The compensation value generation unit 187 provides the compensation value SEN to the timing controller 120. The timing controller 120 may compensate for a data signal based on the compensation value SEN provided from the compensation value generation unit 187.

As illustrated in FIGS. 18 and 19, the compensation driver 180 may be included in the timing controller 120. In this case, the second circuit 140*b* of the data driver 140*a* and 140*b* transfers a sensing value to the timing controller 120.

As such, the present disclosure detects a growing defect potentially existing in a display panel and compensates for the growing defect, thereby improving display quality of a device. In addition, the present disclosure detects a growing defect potentially existing in a display panel and compensates for the growing defect, thereby modifying or offsetting a sensing or compensation error which could occur during external compensation. Furthermore, based on coordinates of an abnormal (defected) sub-pixel, the present disclosure prevents darkening of normal sub-pixels in the surroundings of the abnormal (defected) sub-pixel due to dark spots which are possibly caused by a growing defect. Therefore, driving reliability may improve.

What is claimed is:

1. An organic light emitting display device comprising:

a display panel having a plurality of sub-pixels, each sub-pixel of the plurality of sub-pixels comprising:

a switching transistor including an electrode, a driving transistor including a gate electrode electrically connected to the electrode of the switching transistor, an organic light-emitting diode including an anode electrically connected to a source node of the driving transistor, and a sensing transistor including a first electrode electrically connected to a sensing line and a second electrode electrically connected to the source node of the driving transistor;

a data driver configured to supply a data signal to each of the sub-pixels;

a scan driver configured to supply a scan signal for controlling the switching transistor of each of the sub-pixels, and configured to supply a sensing signal for controlling the sensing transistor of each of the sub-pixels; and a compensation driver configured to sense a voltage of the source node of the driving transistor of each of the sub-pixels via the sensing line, wherein the compensation driver is configured to determine that a short has occurred between at least two electrodes of the switching transistor of the sub-pixel responsive to the sensed voltage in the sensing line being a first voltage, and the compensation driver is configured to determine that a short has not occurred between the at least two electrodes of the switching transistor of the sub-pixel responsive to the sensed voltage being a second voltage higher than the first voltage, and wherein the sensing transistor of a sub-pixel has a turn-on time for detecting whether a short has occurred between at least two electrodes of the switching transistor of the sub-pixel, in response to the sensing signal.

2. The organic light emitting display device of claim 1, wherein the compensation driver determines whether the short has occurred between the at least two electrodes of the switching transistor of the sub-pixel, and generates a compensation value for compensating for the sub-pixel in which the short has occurred.

3. The organic light emitting display device of claim 2, wherein an initialization voltage is supplied to the sensing line during a period in which the data driver outputs a logic-high data signal, the scan signal is in a logic low state, and the sensing signal is in a logic-high state.

4. The organic light emitting display device of claim 1, wherein, in order to detect whether the short has occurred between the at least two electrodes of the switching transistor, the data driver outputs a logic-high data signal during a period in which the scan signal is in a logic-high state.

5. The organic light emitting display device of claim 4, wherein, during a period in which the scan signal is in the logic-high state, the sensing signal is at a logic low state.

6. The organic light emitting display device of claim 1, wherein the sensing transistor of the sub-pixel has the turn-on time during an image display period in which an image is displayed on the display panel or during a power-off sequence period in which the display panel is power-off, wherein the turn-on time is for detecting whether the short has occurred between the at least two electrodes of the switching transistor of the sub-pixel.

7. A driving method of an organic light emitting display device, comprising:

an initialization step for turning off a switching transistor, turning on a sensing transistor, and outputting a logic-high data signal and an initialization voltage;

a program step for turning on the switching transistor, turning off the sensing transistor, outputting the logic-high data signal, and stopping the outputting of the initialization voltage;

a charging step for turning off the switching transistor, turning on the sensing transistor, and stopping the outputting of the logic-high data signal and the initialization voltage so as to charge, in a sensing line, a voltage existing in a source node of a driving transistor, wherein the driving transistor includes a gate electrode electrically connected to an electrode of the switching transistor, and the sensing transistor includes a first electrode electrically connected to the sensing line and a second electrode electrically connected to the source node of the driving transistor; and a sensing step for turning off the switching transistor, turning on the sensing transistor, stopping the outputting of the logic-high data signal and the initialization voltage, and sensing the voltage charged in the sensing line; and determining whether a short has occurred between at least two electrodes of the switching transistor based on the sensed voltage in the sensing line, comprising:

responsive to the sensed voltage in the sensing line being a first voltage, determining the short has occurred between the at least two electrodes of the switching transistor, and responsive to the sensed voltage in the sensing line being a second voltage higher than the first voltage, determining the short has not occurred between the at least two electrodes of the switching transistor.

8. The driving method of claim 7, wherein the sensing step comprises a compensating step in which the voltage charged in the sensing line is sensed, whether a short has occurred between the at least two electrodes of the switching transistor is determined based on a sensing value, and a compensation value for compensating a sub-pixel in which the short has occurred is generated.

9. The driving method of claim 8, wherein, when the sensing value is at logic low, it is determined in the sensing step that the short has occurred between the at least two electrodes of the switching transistor.

10. The driving method of claim 8, wherein the sensing step is performed during an image display period in which an image is displayed on a display panel or during a power-off sequence period in which the display panel is power-off.

11. The driving method of claim 8, wherein the compensating step comprises modifying the compensation value based on coordinates of an abnormal sub-pixel having a switching transistor in which the short has occurred, so that darkening of a normal sub-pixel in surroundings of the abnormal sub-pixel is prevented.

* * * * *